US008032979B2

(12) United States Patent
Boone

(10) Patent No.: US 8,032,979 B2
(45) Date of Patent: Oct. 11, 2011

(54) HEAT EXCHANGER

(75) Inventor: Wayne Eric Boone, Snohomish, WA (US)

(73) Assignee: Hydramaster North America, Inc., Plymouth, MN (US)

( * ) Notice: Subject to any disclaimer, the term of this patent is extended or adjusted under 35 U.S.C. 154(b) by 1470 days.

(21) Appl. No.: 11/363,341

(22) Filed: Feb. 27, 2006

(65) Prior Publication Data

US 2007/0061996 A1 Mar. 22, 2007

Related U.S. Application Data

(60) Provisional application No. 60/717,604, filed on Sep. 17, 2005.

(51) Int. Cl.
*A47L 7/00* (2006.01)

(52) U.S. Cl. ..... 15/321; 165/297; 165/299; 165/300

(58) Field of Classification Search ..... 15/320, 15/321, 540.1; 165/41, 51, 52, 101, 104, 165/103, 292, 293, 297, 298
See application file for complete search history.

(56) References Cited

U.S. PATENT DOCUMENTS

| | | | | |
|---|---|---|---|---|
| 2,586,569 | A | | 2/1952 | Sedgwick |
| 2,894,265 | A | | 7/1959 | Reardon |
| 3,594,849 | A | | 7/1971 | Coshow |
| 3,698,992 | A | | 10/1972 | Armand |
| 3,774,261 | A | | 11/1973 | Colt |
| 3,775,053 | A | | 11/1973 | Wisdom |
| 3,841,910 | A | | 10/1974 | Baker |
| 3,964,458 | A | | 6/1976 | Strauss et al. |
| 4,095,309 | A | | 6/1978 | Sundheim |
| 4,109,340 | A | | 8/1978 | Bates |
| 4,153,968 | A | | 5/1979 | Perkins |
| 4,154,578 | A | | 5/1979 | Bane |
| 4,158,248 | A | | 6/1979 | Palmer |
| 4,161,802 | A | | 7/1979 | Knight et al. |
| 4,207,649 | A | | 6/1980 | Bates |
| 4,284,127 | A | | 8/1981 | Collier et al. |
| 4,336,627 | A | | 6/1982 | Bascus |
| 4,373,453 | A | * | 2/1983 | Foresto ..... 110/216 |
| 4,443,909 | A | | 4/1984 | Cameron |
| 4,593,753 | A | | 6/1986 | McConnell |
| 4,632,787 | A | | 12/1986 | Tippmann |
| 4,803,466 | A | | 2/1989 | Gurstein et al. |
| 4,862,551 | A | | 9/1989 | Martinez et al. |
| 4,862,951 | A | | 9/1989 | Muller et al. |
| 4,940,082 | A | | 7/1990 | Roden |
| 4,949,424 | A | | 8/1990 | Shero |
| 4,991,254 | A | * | 2/1991 | Roden et al. ..... 15/321 |
| 5,095,578 | A | | 3/1992 | Wade |
| 5,165,139 | A | | 11/1992 | Oxman |
| 5,228,413 | A | | 7/1993 | Tam |

(Continued)

*Primary Examiner* — Lee D Wilson
*Assistant Examiner* — Jamal Daniel
(74) *Attorney, Agent, or Firm* — Oppenheimer Wolff & Donnelly LLP; Barbara A. Wrigley

(57) ABSTRACT

A heat exchanger for use with a carpet cleaning system having combined exhaust gases of an internal combustion engine and other hot exhaust gases expelled from a vacuum pump as a single input to a heat exchanger for heating the carpet cleaning fluid. A heat exchanger control system permits constant control of a stream of cleaning fluid both while the cleaning fluid is flowing through the heat exchanger and while the cleaning fluid is stagnant within the heat exchanger, without the potential overheat condition of the portion of cleaning fluid stagnant in the heat exchanger known in prior art devices that required a constant flow of the cleaning fluid.

24 Claims, 5 Drawing Sheets

U.S. PATENT DOCUMENTS 5,265,304 A 11/1993 Hughes
5,299,585 A 4/1994 Dall'Oglio
5,371,918 A 12/1994 Shero
5,377,628 A 1/1995 Adams
5,430,910 A 7/1995 Wiley
5,469,598 A * 11/1995 Sales ..... 15/321
5,606,768 A 3/1997 Sundberg
5,613,271 A 3/1997 Thomas
5,920,953 A 7/1999 Shero
5,979,012 A 11/1999 Fritz
6,032,326 A 3/2000 Roden et al.
6,032,616 A 3/2000 Jones
6,151,748 A 11/2000 Earhart, Jr. et al.
6,182,328 B1 2/2001 Roden
6,216,312 B1 4/2001 Rowan
6,243,914 B1 6/2001 Studebaker
6,382,142 B1 5/2002 Chen
6,517,639 B2 2/2003 Toepfer et al.
6,609,268 B2 8/2003 Miner
6,629,540 B2 10/2003 Mitsumori et al.
6,675,437 B1 * 1/2004 York ..... 15/321
6,804,588 B2 10/2004 Oki et al.
6,877,183 B2 4/2005 Rosa et al.
6,880,191 B2 4/2005 Bristor
6,898,820 B2 5/2005 Kasper et al.
6,925,968 B1 8/2005 Hwang et al.
2004/0134649 A1 * 7/2004 Richardson et al. ..... 165/292
2004/0153280 A1 * 8/2004 Lindgren ..... 702/130

* cited by examiner

HEAT EXCHANGER

This application claims the benefit of U.S. Provisional Application Ser. No. 60/717,604, filed Sep. 17, 2005, the complete disclosure of which is incorporated herein by reference.

FIELD OF THE INVENTION

The present invention relates to heat exchanger devices in general, and in particular to control mechanisms for heat exchanger devices operated in combination with a carpet cleaning apparatus having exhaust gases of an internal combustion engine and a vacuum pump as inputs to the heat exchanger.

BACKGROUND OF THE INVENTION

Currently, in situ cleaning of carpets and upholstery utilizes equipment for heating cleaning liquid that is conveyed under pressure to and sprayed onto the surface to be cleaned and then vacuum removed from the surface with the soil. This equipment is usually mounted in a panel truck, or van, for ease of transport and often includes the transport's internal combustion engine for driving the cleaning liquid and vacuum pumps.

As disclosed in co-pending U.S. patent application Ser. No. 10/329,227 filed Dec. 23, 2002 in the names of Wayne E. Boone, et al. for "Direct Drive Industrial Carpet Cleaner," the complete disclosure of which is incorporated herein by reference, typical industrial floor cleaning systems generally provide for the management of heat, vacuum, pressure, fresh and gray water, chemicals, and power to achieve the goal of efficient, thorough cleaning of different substrates, usually carpets but also hard flooring, linoleum and other substrates, in both residential and commercial establishments. Professional substrate cleaning systems are also utilized in the restoration industry for water extraction.

Of the many industrial substrate cleaning systems available, a major segment are self-contained having an own power plant, heat source, vacuum source, chemical delivery system, and water dispersion and extraction capabilities. These are commonly referred to as "slide-in" systems and install permanently in cargo vans, trailers and other commercial vehicles, but can also be mounted on portable, wheeled carts. Slide-in systems comprise a series of components designed and integrated into a package with an overall goal of performance, economy, reliability, safety, useful life, serviceability, and sized to fit inside various commercial vehicles.

FIG. 1 schematically illustrates one state-of-the-art industrial slide-in substrate cleaning system 1 (shown without scale) for carpets, hard flooring, linoleum and other substrates, one well-known example of which is the self-contained, gas-powered, truck-mounted model that is commercially available from Hydramaster Corporation, Mukilteo, Wash.

Typically, the components of a conventional slide-in carpet cleaner system 1 are structured around a frame or structural platform 2 onto which the majority of the components are mounted. The slide-in 1 typically includes a drive system 3 mounted on the platform 2 and having a power plant 4 coupled to receive fuel from an appropriate supply, a vacuum pump 5 that is the source of vacuum for removing gray water or soiled cleaning solution from the cleaned substrate, either carpet or other flooring, and an interface assembly 6 for transmitting power from the power plant 4 to the vacuum pump 5. The power plant 4 may be, for example, any steam or electric motor, but is usually an internal combustion motor, such as a gasoline, diesel, alcohol, propane, or otherwise powered internal combustion engine. A standard truck battery 7 is provided as a source of electric energy for starting the engine. An intake hose 8 is coupled to a source of fresh water, and a water pump or air compressor 9 driven by the power plant via V-belt (shown), direct drive, or otherwise for pressurizing the fresh water. One or more heat exchangers and associated plumbing 10 are coupled for receiving the pressurized fresh water and heating it. A recovery tank 11 is provided wherein gray water or soiled cleaning solution is stored after removal from the cleaned surface. A high pressure solution hose 12 is provided for delivering pressurized, hot water/chemical cleaning solution from the machine via a wand or cleaning tool 14 to the substrate to be cleaned, usually a carpet or hard flooring, and a chemical container 13 or other chemical system is coupled for delivering a stream of cleaning chemical additives into the hot water, typically as it enters the high-pressure solution hose 12. The wand or cleaning tool 14 is coupled to the high pressure solution hose 12 for receiving and dispersing the pressurized hot water/chemical cleaning solution to the carpet. The wand or cleaning tool 14 is the only "portable" part of truck-mount slide-in professional carpet cleaning systems 1 in that it is removed from the vehicle and carried to the carpet or other substrate to be cleaned, and it is the only equipment that makes physical contact with the carpet to be cleaned. A vacuum hose 15 is coupled to the wand or cleaning tool 14 for recovering the soiled water-based chemical cleaning solution from the cleaned surface via the wand or cleaning tool and delivering it to the recovery tank. Valves 16 and 17 control coupling of the hot water/chemical cleaning solution and recovery vacuum, respectively, to the wand or cleaning tool 14. The control valves 16, 17 may be either separate control valves (shown) or combined in a single control valve.

The slide-in or portable system 1 operates by delivering fresh water to an inlet to the system, utilizing either a standard garden hose or a fresh-water container. The system 1 adds energy to the fresh water, i.e., pressurizes it, by means of the pump or air compressor 9. The fresh water is pushed throughout the heat exchanger apparatus and associated plumbing 10 using pressure provided by either the pump or air compressor 9. The heat exchangers 10 gain their heat by thermal energy rejected from the power plant 4, e.g., from hot exhaust gases, coolant water used on certain engines, or another known means. On demand from the wand or cleaning tool 14, the heated fresh water is mixed with chemicals from the container 13 as the hot water is exiting the machine and entering the high-pressure hose 12. The hot water travels typically, but not limited to, between 50 feet to 300 feet to the wand or cleaning tool 14. The operator delivers the hot solution via the wand or cleaning tool 14 to the carpet or other surface to be cleaned and almost immediately extracts it along with soil that has been emulsified by thermal energy or dissolved and divided by chemical energy. The extracted, soiled water or cleaning solution is drawn via the vacuum hose 15 into the recovery tank 11 for eventual disposal as gray water.

It has been suggested that instead of using a separate heater for heating the cleaning liquid that waste heat from the internal combustion engine be used for that purpose. U.S. Pat. No. 4,593,753, granted Jun. 10, 1986 to P. J. McConnell for "Exhaust Gas Liquid Heating System For Internal Combustion Engines" discloses a system for heating water with exhaust gas heat. U.S. Pat. No. 4,109,340 granted Aug. 29, 1978 to L. E. Bates for "Truck Mounted Carpet Cleaning Machine" discloses a system in which the cleaning liquid is passed first through the cylinder block of a liquid cooled, internal combustion engine and then through a heat exchanger which also has engine exhaust gases passing therethrough. U.S. Pat. No. 4,284,127 granted Aug. 18, 1981 to D. S. Collier et al for "Carpet Cleaning Systems" discloses a similar system which directs the cleaning liquid through a first heat exchanger into which the liquid engine coolant also is directed. The preheated cleaning liquid then passes through a second heat exchanger where it extracts heat from the engine exhaust gases.

In all of the aforementioned systems in which the cleaning liquid is directed in heat exchange relationship with the exhaust gases of the internal combustion engine there is a danger that the cleaning liquid could become overheated. To avoid damage to surfaces to be cleaned the temperature of the cleaning liquid, as a general rule, should not exceed 250 degrees F. Internal combustion engine exhaust gases can reach temperatures as high as 1650 degrees F. With the engine running and a low flow rate for the cleaning liquid the latter can rapidly be heated to an undesirably high temperature in the exhaust gas heat exchange.

One attempt at a solution for controlling the cleaning liquid temperature is disclosed by U.S. Pat. No. 3,594,849 granted Jul. 27, 1971 to C. L. Coshow for "Cleaning Apparatus" which provides a cleaning system in which air and heated cleaning fluid recovered from a carpet is conveyed in heat exchange relationship with cleaning liquid being conveyed to the carpet.

More typically, a thermostatically controlled dump valve is incorporated for dumping the overheated cleaning liquid before it can reach the surface to be cleaned. One such dumping arrangement is described hereinafter and in the aforementioned U.S. Pat. No. 4,940,082 granted Jul. 10, 1990 to James R. Roden for "Cleaning System," the complete disclosure of which is incorporated herein by reference. U.S. Pat. No. 4,940,082 also disclosed utilization of the heat contained in the return air stream after it passed through the vacuum pump. Because the vacuum pump adds a significant quantity of heat to this air stream useful heat can be obtained from its exhaust and imparted to the cleaning liquid being heated. However, U.S. Pat. No. 4,940,082 offered no suggestions for preventing overheating of the cleaning liquid in heat exchange relationship with the engine exhaust gases.

U.S. Pat. No. 4,991,254 granted Feb. 12, 1991 to Roden, et al. for "Cleaning System," the complete disclosure of which is incorporated herein by reference, disclosed extracting heat both from the exhaust gases of an internal combustion engine and the air exiting a vacuum pump to heat the cleaning liquid. Heat from these two sources was mixed before imparting it to the cleaning liquid by mixing the exhaust gases and the air from the vacuum pump before placing the mixture in heat exchange relationship with the cleaning liquid. U.S. Pat. No. 4,991,254 also disclosed utilizing heat from a cooling system for the internal combustion engine to further heat the cleaning liquid. A thermostatically controlled dump valve in a high pressure hose at the exit of second heat exchanger prevents delivery of too high temperature cleaning liquid to the cleaning wand. The dump valve detects cleaning liquid temperature in excess of 250 degrees F and opens, thereby dumping the over heated cleaning liquid into waste tank until the cleaning liquid at the exit from heat exchanger again has a temperature within the desired range.

However, in some applications it would be desirable to avoid wasting the unused cleaning liquid by dumping it when it gets too hot.

SUMMARY OF THE INVENTION

The present invention is a heat exchanger for use with a carpet cleaning system having combined relatively hotter exhaust gases of an internal combustion engine and other hot exhaust gases expelled from a vacuum pump at a temperature relatively cooler than the engine exhaust gases as a single input to the heat exchanger. The present invention overcomes limitations of prior art devices by providing a heat exchanger control system that permits constant control of a stream of cleaning fluid both while the cleaning fluid is flowing through the heat exchanger and while the cleaning fluid is stagnant within the heat exchanger. Prior art devices required a constant flow of the cleaning fluid to avoid a potential overheat condition of the portion of cleaning fluid stagnant in the heat exchanger. Rather than permit interruptions in the constant flow of cleaning fluid through the heat exchanger, prior art devices re-circulated or simply dumped the fluid which permitted the flow through the heat exchanger to remain constant. In contrast, heat exchanger of the present invention permits interruptions in the flow of cleaning fluid without overheating the stagnant portion held in the heat exchanger.

According to one aspect of the invention, the invention is a liquid heating system having a first pipe that is structured to convey hot gases from an internal combustion engine as a first source of relatively higher temperature gases and a second pipe that is structured to convey hot gases from a vacuum pump as a second source of relatively lower temperature gases, with both the first and second pipes communicating with a gas mixing chamber that is structured for mixing relatively higher and lower temperature hot gases received therein. A heat exchange chamber is provided having an inlet that is coupled to the gas mixing chamber for receiving hot gases thereinto and having a heat exchange mechanism that is structured for passing pressurized liquid therethrough in thermal transfer communication with the hot gases, the heat exchange chamber is structured for exhausting the hot gases downstream of the heat exchange mechanism. A diverter is coupled between the first pipe and the gas mixing chamber, the diverter being structured for communicating between the first pipe and the gas mixing chamber as a function of a temperature of the mixed hot gases measured downstream of the inlet of the heat exchange chamber.

According to another aspect of the invention, the diverter includes a diverter valve that is operable between a first outlet that communicates with the gas mixing chamber and a second outlet that is inhibited from communication with the gas mixing chamber.

According to another aspect of the invention, the diverter valve is further responsive to a control signal generated by a control circuit as a function of the temperature of the mixed hot gases measured downstream of the inlet of the heat exchange chamber.

According to another aspect of the invention, the liquid heating system of the invention also includes a temperature sensor that is positioned downstream of the inlet of the heat exchange chamber. Optionally, the temperature sensor is positioned adjacent to an exhaust outlet of the heat exchange chamber.

According to another aspect of the invention, the liquid heating system of the invention is included in an industrial carpet cleaner system having a power plant of a type that produces hot exhaust gases and having an exhaust outlet that is coupled to the first pipe; a vacuum generator of a type that produces hot exhaust gases and having an exhaust outlet that is coupled to the second pipe; and a pump or other liquid pressurizing device that is coupled to an inlet of the heat exchange mechanism for forcing liquid to be heated through the heat exchange mechanism. According to another aspect of the invention, the industrial carpet cleaner system also includes a fluid dispersal and retrieval device, commonly referred to as a spray wand or cleaning head, that is coupled by a high pressure hose to an outlet of the heat exchange mechanism for receiving the heated liquid, and by a vacuum hose to the vacuum pump for retrieval of the spent cleaning fluid. Optionally, a waste recovery vessel is coupled to one end of the vacuum hose between the fluid dispersal device and the vacuum pump for storing gray water or soiled cleaning solution is after removal from the cleaned surface.

According to another aspect of the invention, a method is provided for heating a liquid, the method including conveying liquid to be heated to a heat exchange mechanism positioned within a heat exchange chamber; conveying hot gases from an internal combustion engine as a first source of relatively higher temperature hot gases to a gas mixing chamber; conveying hot gases from vacuum pump as a second source of relatively lower temperature gases to a gas mixing chamber; conveying mixed hot gases from a the gas mixing chamber into the heat exchange chamber and into thermal transfer communication with the heat exchange mechanism for transferring heat from the gases to the liquid to be heated; and intermittently temporarily diverting substantially all or at least a portion of the relatively higher temperature hot gases away from the gas mixing chamber as a function of measuring a temperature of the gases after transferring heat from the gases to the liquid to be heated.

According to another aspect of the method of the invention, diverting at least a portion of the relatively higher temperature hot gases away from the gas mixing chamber includes alternately diverting substantially all or at least a portion of the relatively higher temperature hot gases from the internal combustion engine away from the gas mixing chamber, and directing substantially all or at least a portion of the relatively higher temperature hot gases into the gas mixing chamber both as a function of measuring a temperature of the gases after transferring heat from the gases to the liquid to be heated.

According to another aspect of the method of the invention, the method also includes controlling the alternately diverting and directing of the relatively higher temperature hot gases away from or into the gas mixing chamber for maintaining the temperature of the gases after transferring heat from the gases to the liquid to be heated within a selected range of temperatures.

According to another aspect of the method of the invention, alternately diverting and directing the relatively higher temperature hot gases away from or into the gas mixing chamber optionally includes conveying hot gases from a first source of relatively higher temperature hot gases into a diverter and operating the diverter for alternately diverting and directing at least a portion of the relatively higher temperature hot gases away from or into the gas mixing chamber.

These and other aspects of the invention are detailed herein.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF PREFERRED EMBODIMENT

In the Figures, like numerals indicate like elements.

Figure 1:
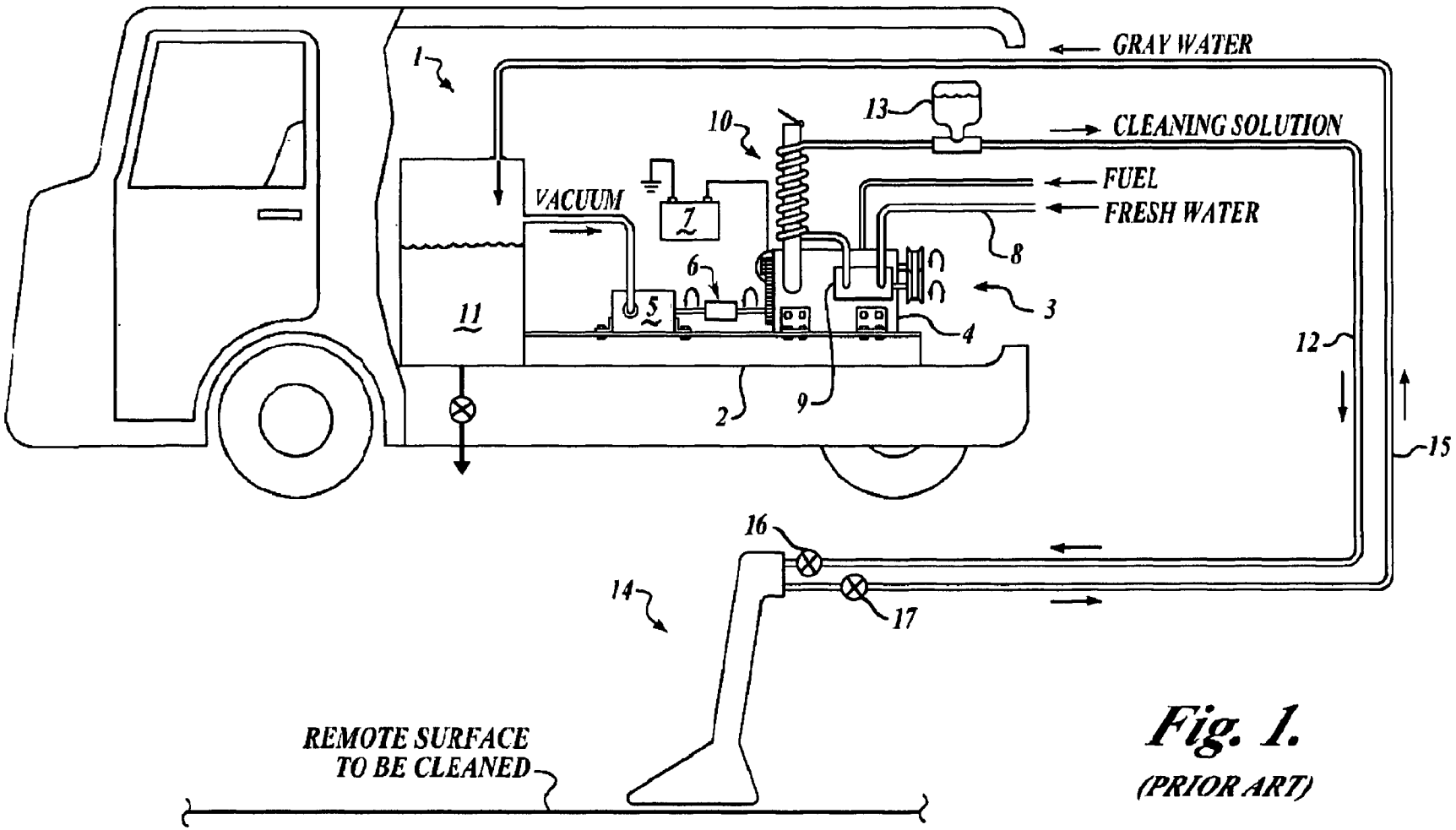
Fig. 1. (PRIOR ART)
FIG. 1 schematically illustrates a state-of-the-art industrial carpet cleaner system installed in a van.
Figure 2:
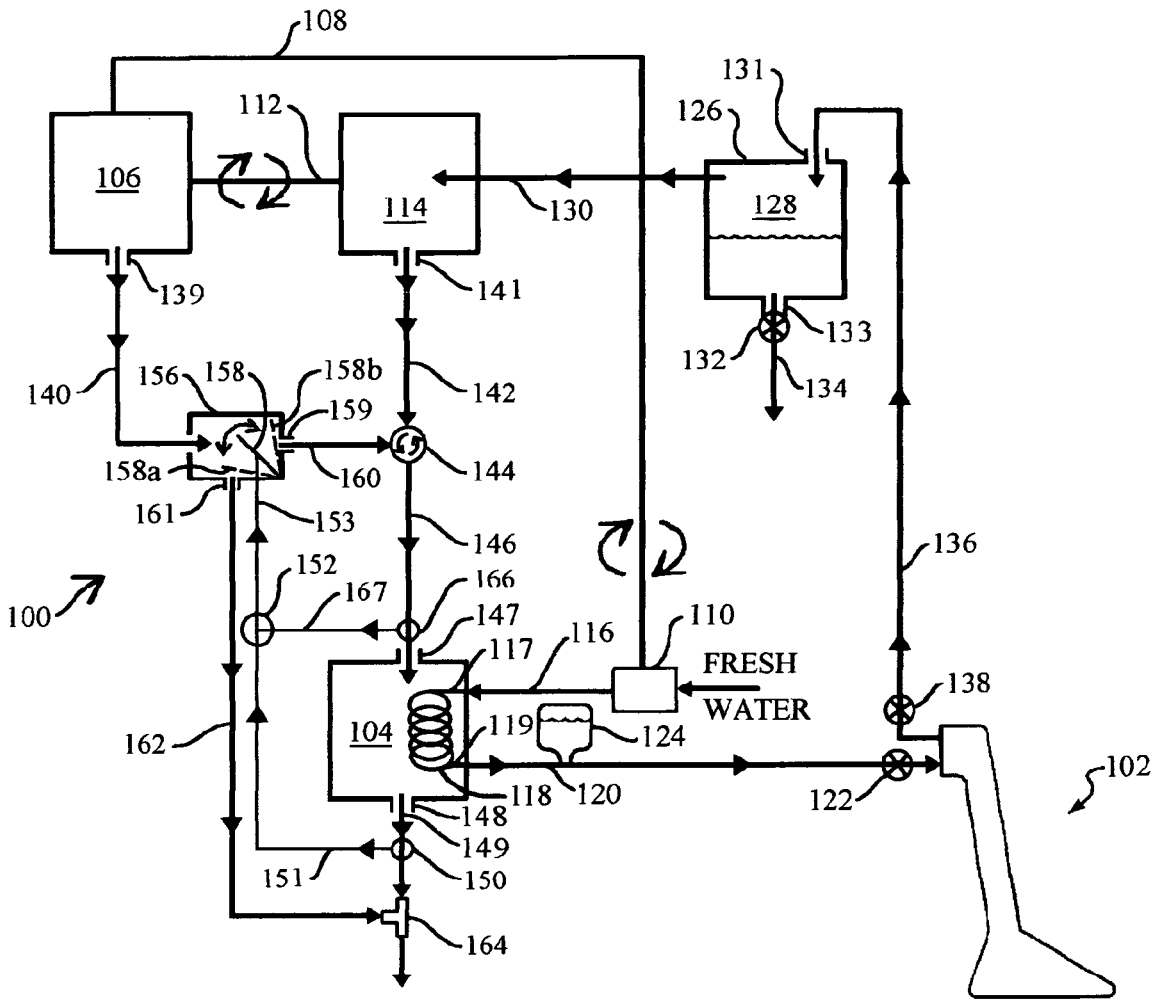
FIG. 2 schematically illustrates a first embodiment of the heat exchanger apparatus of the present invention in combination with a carpet cleaning apparatus having exhaust gases of an internal combustion engine and a vacuum pump as inputs to the heat exchanger.
Figure 3:
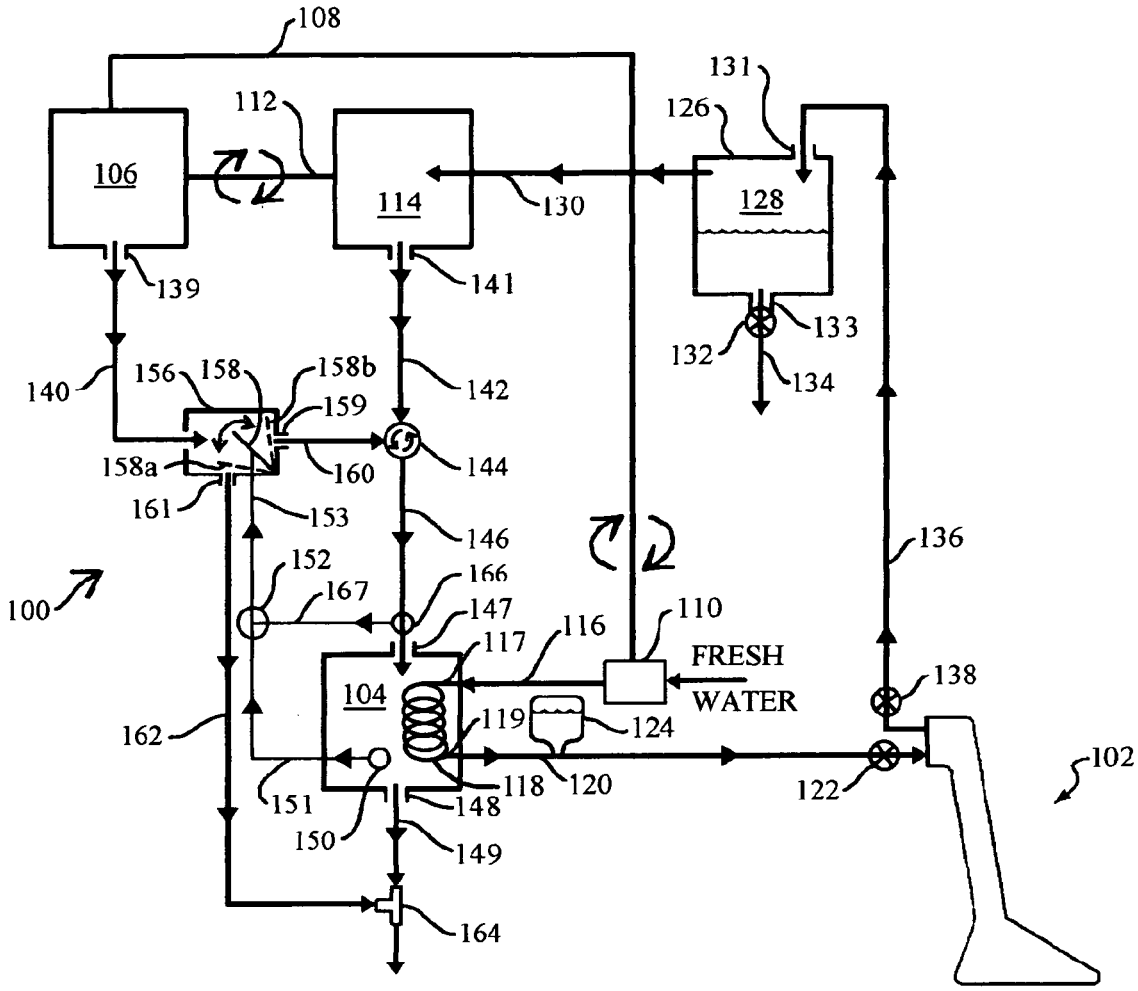
FIG. 3 schematically illustrates a second alternative embodiment of the heat exchanger apparatus of the present invention in combination with a carpet cleaning apparatus having exhaust gases of an internal combustion engine and a vacuum pump as inputs to the heat exchanger.

FIG. 2 and FIG. 3 both illustrate the present invention embodied as a carpet cleaning apparatus 100 of a type generally similar to that illustrated in FIG. 1, except for the novel heat exchanger of the invention. The carpet cleaning apparatus 100 of the invention has, for example, a means for providing a source of pressurized cleaning fluid to a spray wand or other cleaning fluid dispersal and retrieval device 102 of a type generally well-known in the art. The cleaning fluid is passed through a heat exchange chamber or heat exchanger 104 for being heated to a desired temperature, such as approximately 200 degrees F in one application, or up to a maximum of about 250 degrees F for typical applications.

The carpet cleaning apparatus 100 includes mechanical structure that is configured for accomplishing tasks of pressurizing and pressurizing the cleaning fluid, and retrieving spent cleaning fluid discharged by the wand 102. For example, the carpet cleaning apparatus 100 includes an internal combustion engine or other conventional power plant 106 of a type that produces hot exhaust gases. The engine or other power plant 106 is coupled by a shaft or belt drive mechanism 108 to drive a water pump or other liquid pressurizing device 110 for pressurizing the cleaning fluid, whereby the pressurizing device 110 operates as source of pressurized cleaning fluid for delivery to the fluid dispersal device or cleaning wand 102. The power plant 106 is also coupled by a shaft or belt drive mechanism 112 to drive a vacuum generator or pump 114 for retrieving the spent cleaning fluid. Such a carpet cleaning apparatuses are generally well known, as disclosed, by example and without limitation, by Studebaker in U.S. Pat. No. 6,243,914, Sprayless Surface Cleaner, and several other U.S. patents disclosed or reference therein, which are incorporated herein by reference. See, also, U.S. patent application Ser. No. 10/329,227 by Wayne E. Boone, et al. for "Direct Drive Industrial Carpet Cleaner," and both U.S. Pat. No. 4,991,254 to Roden, "Cleaning System" and U.S. Pat. No. 4,940,082 to Roden, entitled "Cleaning System" which are all herein above incorporated by reference.

The cleaning fluid pressurizing device 110 is coupled by appropriate high-pressure input plumbing 116 for delivering pressurized cleaning fluid, i.e., pressurized water with or without cleaning chemical additives, to the heat exchanger 104 of the carpet cleaning apparatus 100. The heat exchanger 104 receives the pressurized cleaning fluid into an inlet 117 of an internal heat exchange mechanism 118, such as a coil of thermally conductive metal or other thermally conductive material, that is in thermal transfer communication with hot gases within the heat exchanger. The heat exchanger 104 subsequently outputs heated pressurized cleaning fluid through a high-pressure hose 120 coupled to an outlet 119 of the internal heat exchange mechanism 118.

and an operator-manipulated delivery control valve 122 to the spray wand or other cleaning fluid dispersal and retrieval device 102 for receiving and dispersing the pressurized hot water/chemical cleaning solution to the carpet, as is generally well-known in the art. The pressurizing device 110 and associated high-pressure input plumbing 116 thus constitute means for conveying cleaning fluid through the heat exchanger 104 to the spray wand 102.

A chemical container 124 or other chemical system is coupled for delivering a stream of cleaning chemical additives into the hot water, typically as it enters the high-pressure solution hose 120. However, the chemical container 124 may be coupled to the high-pressure plumbing 116 for delivering the cleaning chemical additives into the pressurized fresh water before entering the heat exchanger 104.

A waste recovery vessel or tank 126 is provided wherein gray water or soiled cleaning solution is stored after removal from the cleaned surface. Vacuum generator or pump 114 is in communication with an interior 128 of the waste recovery tank 126 through a vacuum line 130 for drawing a vacuum in the recovery tank 126. A fluid inlet 131 receives recovered gray water or soiled cleaning solution into the recovery tank 126, and a drain valve 132 permits later draining of the stored liquid via a drain 133 to a drain pipe 134. A vacuum hose 136 is coupled to the wand or cleaning tool 102 via a vacuum control valve 138 for recovering the soiled water-based chemical cleaning solution from the cleaned surface and delivering it to the inlet 131 of the recovery tank 126. The vacuum control valve 138 is optionally combined with the delivery control valve 122 in a single combination control valve.

The operator delivers the hot solution via the wand or cleaning tool 102 to the carpet or other surface to be cleaned and almost immediately extracts it along with soil that has been emulsified by thermal energy or dissolved and divided by chemical energy. The extracted, soiled water or cleaning solution is drawn via the vacuum hose 136 into the recovery tank 126 for eventual disposal as gray water.

Heat exchanger 104 has as heat source inputs both hot exhaust gases generated by the engine or power plant 106 and other hot exhaust gases generated by the vacuum pump 114. As discussed above, output exhaust gases generated by internal combustion engines can reach temperatures as high as 1000-1200 degrees F. The air expelled from vacuum pump 114 also contains a considerable amount of heat, particularly heat generated by its own compressive action. For example, it is well-known that air may enter vacuum pump at around 120-130 degrees F and exit it at the temperature of around 200 degrees F. The engine or power plant 106 includes an exhaust outlet 139 coupled to an exhaust pipe 140. The vacuum pump 114 includes an exhaust outlet 141 coupled to its own exhaust pipe 142. The hot engine exhaust gases and expelled vacuum pump gases are output through the respective exhaust pipes 140, 142 which both communicate with a gas mixing chamber or mixer 144. The mixer 144 combines and mixes the hot exhaust gases from the engine 106 and vacuum pump 114 and outputs the hot gas mixture via a transfer pipe 146 which is coupled to an inlet duct 147 of the heat exchanger 104. Pressurized cleaning fluid enters the heat exchanger 104 via the high pressure input plumbing 116 and in a known manner absorbs heat from the hot exhaust gases entering from the mixer 144. The heated pressurized cleaning fluid exits the heat exchanger 104 taking a portion of the heat from the exhaust gases with it to the spray wand or other cleaning fluid dispersal device and retrieval 102. The exhaust gases in the heat exchanger are cooled by giving up heat to the cleaning fluid. Thereafter, the cooled exhaust gases exit the heat exchanger 104 via an exhaust outlet 148 coupled to an exhaust pipe 149.

As is known in the art, there is a danger that the cleaning fluid could become overheated in the heat exchange relationship with the exhaust gases of the internal combustion engine. As is also known, the temperature of the cleaning liquid, as a general rule, should not exceed 220 degrees F to avoid damage to surfaces to be cleaned. A direct heat exchange relationship with the exhaust gases of the internal combustion engine can heat the cleaning fluid to an undesirably high temperature. Similarly, it is known in the art that heating the cleaning fluid using engine exhaust gases mixed with hot gases from the vacuum pump still requires the cleaning fluid to run almost continuously to avoid overheating, whereby a thermostatically controlled dump valve is necessary for dumping over heated cleaning fluid into waste tank to maintain its temperature within the desired range when the demand for the cleaning fluid is temporarily suspended.

The present invention overcomes the necessity for dumping over heated cleaning fluid and thereby eliminates the thermostatically controlled dump valve required in prior art systems. An exhaust gas temperature sensor 150 is positioned to measure a temperature of the mixed hot exhaust gases measured downstream of the heat exchanger inlet duct 147 and the heat exchange mechanism 118. For example, the exhaust gas temperature sensor 150 is positioned adjacent to the exhaust outlet 148, either outside or inside the heat exchanger 104. According to one embodiment illustrated in FIG. 2, the exhaust gas temperature sensor 150 is optionally positioned adjacent to the exhaust outlet 148 outside the heat exchanger 104 for measuring an exit temperature of the cooled exhaust gases exiting the heat exchanger 104 through an exhaust pipe 149. Alternatively, as illustrated in FIG. 3, the exhaust gas temperature sensor 150 is optionally positioned adjacent to the exhaust outlet 148 inside the heat exchanger 104 for measuring a temperature of the exhaust gases still within the heat exchanger 104 but cooled by communicating with the heat exchange mechanism 118 and heating the liquid flowing through it. For example, the exhaust gas temperature sensor 150 is positioned inside the heat exchanger 104 downstream of the heat exchange mechanism 118. The temperature sensor 150 is either a probe that measures the exhaust gas temperature either directly by immersion in the stream of exhaust gases, or a sensor mounted on the exhaust pipe 149 that measures the exhaust gas temperature indirectly by measuring a surface temperature of the exhaust pipe 149. The exhaust gas temperature sensor 150 generates and outputs a signal 151 representative of the measured exhaust gas temperature from the heat exchanger 104.

The exhaust gas temperature sensor 150 is part of a control circuit 152 that is structured to generate and output a control signal 153 as a function of the exhaust gas temperature sensor output signal 151. For example, the control circuit 152 includes a microprocessor that generates the control signal 153 as a function of a changing voltage of the temperature sensor output signal 151. The control circuit 152 is structured to control a diverter 156 in the exhaust pipe 140 leading from the engine 106 to the mixer 144. The diverter 156 is equipped with a diverter valve 158 operable between a HEAT MODE and a DIVERT MODE as a function of the control signal 153 output by the control circuit 152. In the HEAT MODE, the valve 158 of the diverter 156 is operated to open a first path through a first transfer outlet 159 that is coupled to a transfer pipe 160 leading to the gas mixer 144. Accordingly, in the HEAT MODE the operation of the diverter valve 158 causes the relatively higher temperature hot exhaust gases from the engine 106 to be delivered to the gas mixer 144 where they are mixed with the relatively lower temperature hot gases from the vacuum pump 114. The mixed hot gases are then delivered to the heat exchanger 104 via the transfer pipe 146, as discussed above. In the HEAT MODE, operation of the valve 158 of the diverter 156 also closes a second path through a second exhaust outlet 161 that is coupled to a diverter exhaust pipe 162 leading away from the gas mixer 144. Accordingly, in the HEAT MODE the operation of the diverter valve 158 inhibits the hot exhaust gases from being diverted away from the mixer 144 through the diverter exhaust pipe 162.

In the DIVERT MODE, the valve 158 of the diverter 156 is operated to close the first transfer outlet 159 leading to the gas mixer 144, and to simultaneously open the second exhaust outlet 161 which opens the second path through the diverter pipe 162 leading away from the mixer 144 for being exhausted into the surrounding environment instead. Accordingly, in the DIVERT MODE the operation of the diverter valve 158 inhibits the hot exhaust gases from communicating with the mixer 144, and instead diverts the hot exhaust gases away from the mixer 144 and into the diverter exhaust pipe 162. By example and without limitation, the diverter pipe 162 optionally connects with the heat exchanger exhaust pipe 149 sufficiently far downstream of the sensor 150 as to have no effect on its sensing temperature of gases in the heat exchanger exhaust pipe 149. For example, the diverter pipe 162 connects with the heat exchanger exhaust pipe 149 at a "T" coupler 164 before the heat exchanger exhaust pipe 149 continues to the atmosphere.

In operation, the valve of the diverter 156 is controlled by the control circuit 152 as a function of the sensor 150 sensing the exit temperature of the heat exchanger gases, which is a direct measure of the heat lost to from the hot gases in the heat exchanger 104, and is an indirect measure of the heat absorbed by the cleaning fluid passing through the heat exchanger 104. The diverter 156 is operated as a function of the sensor 150 output to controllably reduce or increase the amount of engine exhaust gases channeled to the mixer 144. When the heat exchanger exhaust temperature falls below a minimum as sensed by the sensor, the control circuit 152 causes the valve 158 to divert more hot exhaust gases from the engine 106 to the mixer 144 for raising the temperature of in the heat exchanger 104. When the heat exchanger exhaust temperature rises above a maximum as sensed by the sensor 150, the control circuit 152 causes the valve 158 to divert more hot exhaust gases from the engine 106 into the diverter pipe 162 and away from the mixer 144 for lowering the temperature in the heat exchanger 104. Accordingly, the temperature in the heat exchanger 104 is held substantially steady and the cleaning fluid can lie stagnant in the heat exchanger 104 and remain hot but without overheating because the diverter 156 is controlled so that the heat exchanger is not permitted either to fall below the minimum exhaust temperature, nor to rise above the maximum exhaust temperature, as measured by the sensor 150.

Optionally, the diverter 156 is an "on-off" device wherein the valve 158 is caused to operate at extremes between a first HEAT MODE position 158*a* that completely opens the input path to the mixer 144 through the transfer pipe 160, and simultaneously substantially closes off the exhaust path through the diverter exhaust pipe 162 to the atmosphere, and a second DIVERT MODE position 158*b* that substantially closes off the input path to the mixer 144 through the transfer pipe 160, and simultaneously completely opens the path through the diverter exhaust pipe 162 to the atmosphere. Alternatively, the diverter 156 is a continuous or graduated device wherein the valve 158 is operable continuously or incrementally between the extreme first HEAT MODE position 158*a* and the second DIVERT MODE position 158*b*. Rather, the valve 158 is of a type that is structured to operate at one or more positions wherein each of the paths to the mixer 144 through the transfer pipe 160 and the exhaust path through diverter exhaust pipe 162 are simultaneously open to the same or different degrees for passing a portion of the engine exhaust gases through to the mixer 144, and simultaneously exhausting a larger or smaller portion of the engine exhaust gases to the atmosphere. The diverter valve 158 is thus maintained in a substantially constant position while the cleaning fluid is moving through the heat exchanger 104 during operation of the cleaning wand 102, rather than fluctuating between the extreme first HEAT MODE 158*a* and second DIVERT MODE positions 158*b*.

Of course, the diverter valve 158 optionally includes first and second valves with one of the valves (indicated by the designator 158*a*) opening and closing the second exhaust outlet 161 that is coupled to a diverter exhaust pipe 162 leading away from the gas mixer 144, and another one of the valves (indicated by the designator 158*b*) opening and closing the first transfer outlet 159 that is coupled to a mixer input pipe 160 leading to the gas mixer 144. The first and second valves operate in concert both to control the amount of hot engine exhaust gases let into the mixer, and to avoid simultaneously sealing both the first transfer outlet 159 and second exhaust outlet 161 and choking the engine 106.

Optionally, an input gas temperature sensor 166 is positioned on the mixer transfer pipe 146 sufficiently close to the inlet duct 147 of the heat exchanger 104 for effectively measuring an input temperature of the exhaust gases to the heat exchanger 104, which is substantially the same as the exhaust gas temperature of the mixer 144.

The optional input gas temperature sensor 166 outputs a signal 167 representative of the measured input gas temperature to the heat exchanger 104. The heat exchanger input gas temperature signal 167 is provided as a second input to the control circuit 152, whereby the control signal 153 is generated as a function of both the heat exchanger exhaust gas temperature sensor output signal 151 and the heat exchanger input gas temperature sensor output signal 167. The diverter valve 158 is thus operable between the HEAT MODE and a DIVERT MODE as a function of input from both the heat exchanger exhaust gas temperature sensor 150 and the heat exchanger input gas temperature sensor 166. For example, the control signal 153 is generated as a function of the differential between the gas entrance and exit temperatures as measured respectively at the inlet duct 147 and the exhaust outlet 148 of the heat exchange chamber 104. Accordingly, the measure of heat absorbed by the cleaning fluid from the hot gases in the heat exchanger 104 may be more precise, which may be useful in controlling the cleaning fluid temperature.

Figure 4:
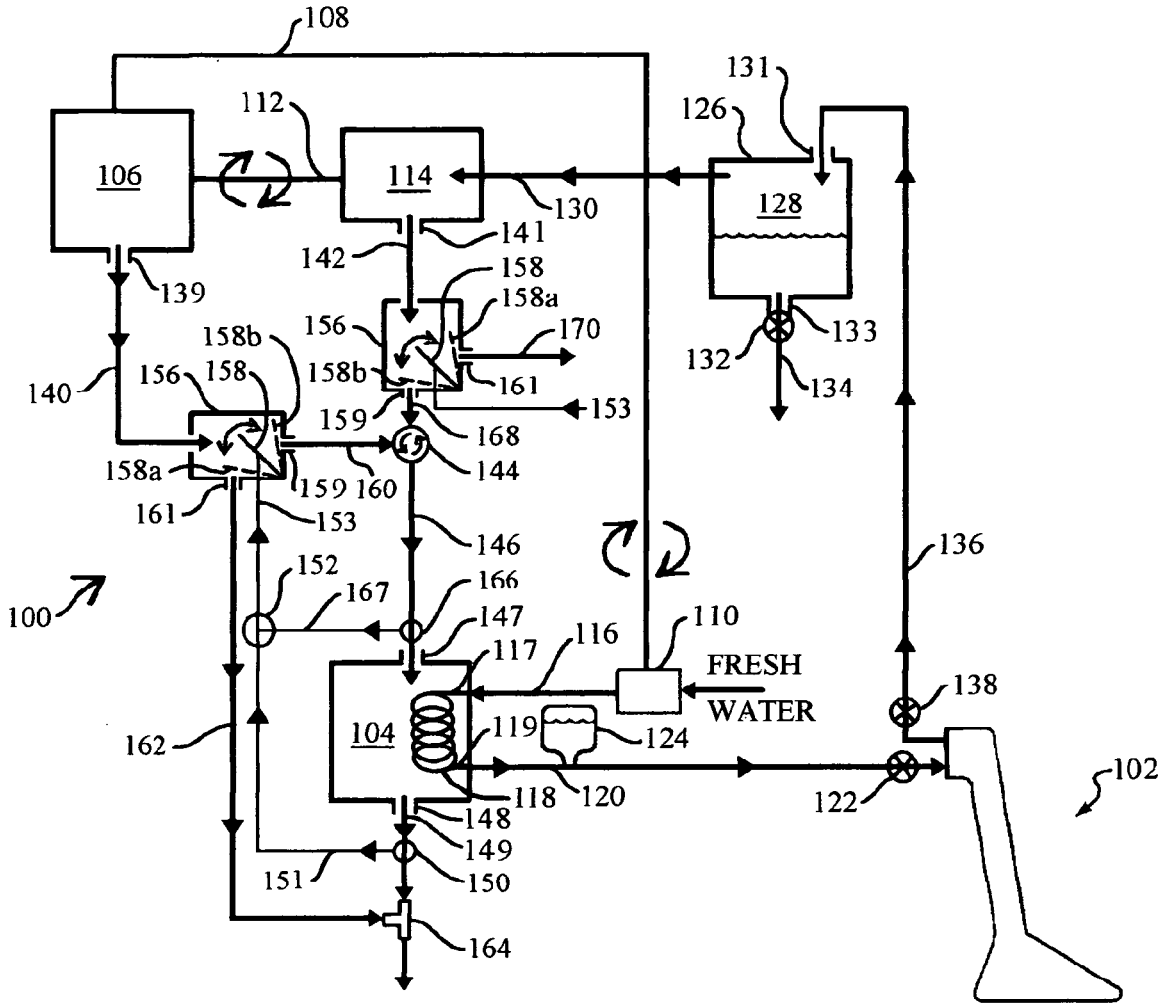
FIG. 4 illustrates another alternative embodiment of the carpet cleaning apparatus of the present invention having a pair of exhaust gas diverters for directing hot gasses from the internal combustion engine and vacuum pump to a mixing chamber before delivery to the heat exchanger.

FIG. 4 illustrates another alternative embodiment of the carpet cleaning apparatus 100 of the present invention having the novel heat exchanger 104 of the invention, and further including a second one of the diverters 156 in the exhaust pipe 142 leading from the exhaust outlet 141 of the vacuum pump 114 to the mixer 144. The second diverter 156 is also equipped with a diverter valve 158 operable between the HEAT MODE and the DIVERT MODE as a function of the control signal 153 output by the control circuit 152 which is responsive to the first exhaust gas temperature sensor output signal 151, and the second exhaust gas temperature sensor output signal 167 if present, as discussed above. In the HEAT MODE, the valve 158 of the second diverter 156 is operated to open a first path through its first transfer outlet 159 that is coupled to another transfer pipe 168 leading to the gas mixer 144. Accordingly, in the HEAT MODE the operation of the diverter valve 158 causes the relatively lower temperature hot gases from the vacuum pump 114 to be delivered to the gas mixer 144 where they are mixed with the relatively higher temperature hot exhaust gases from the engine 106. The mixture of hot gases is then delivered to the heat exchanger 104 via the transfer pipe 146, as discussed above. In the HEAT MODE, operation of the valve 158 of the second diverter 156 also closes the second path through the second exhaust outlet 161 that is coupled to another diverter exhaust pipe 170 leading away from the gas mixer 144. Accordingly, in the HEAT MODE the operation of the diverter valve 158 of the second diverter 156 inhibits the hot exhaust gases from the vacuum pump 114 from being diverted away from the mixer 144 through the second diverter exhaust pipe 170.

In the DIVERT MODE, the valve 158 of the second diverter 156 is operated to close the first transfer outlet 159 leading to the gas mixer 144, and to simultaneously open the second exhaust outlet 161 which opens the second path through the diverter exhaust pipe 170 leading away from the mixer 144 for being exhausted into the surrounding environment instead. Accordingly, in the DIVERT MODE the operation of the diverter valve 158 of the second diverter 156 inhibits the hot exhaust gases from communicating with the mixer 144, and instead diverts the hot exhaust gases away from the mixer 144 and into the second diverter exhaust pipe 170.

As discussed above, the second diverter 156 also is either a continuous or graduated device, or alternatively an "on-off" device wherein the valve 158 of the second diverter 156 operates at extremes between the first HEAT MODE position 158*a* that completely opens the input path to the mixer 144 through the transfer pipe 160, and simultaneously substantially closes off the exhaust path through the diverter exhaust pipe 170 to the atmosphere, and the second DIVERT MODE position 158*b* that substantially closes off the input path to the mixer 144 through the transfer pipe 160, and simultaneously completely opens the exhaust path through the diverter exhaust pipe 170 to the atmosphere.

According to one embodiment of the invention, the control signal 153 output by the control circuit 152 is a single signal transmitted to both the first and second diverters 156. Optionally, the control circuit 152 outputs two different control signals 153. A first control signal 153 is output to the first diverter 156 that is coupled between the engine 106 and the mixer 144, and a different second control signal 153 is output to the second diverter 156 that is coupled between the vacuum pump 114 and the mixer 144. Accordingly, the two diverters 156 may be operated independently of one another for delivering the exhaust gases from the engine 106 and vacuum pump 114 to the mixer 144 either individually or in any desired combination for maintaining the cleaning fluid in the heat exchanger 104 at a desired temperature without overheating.

Figure 5:
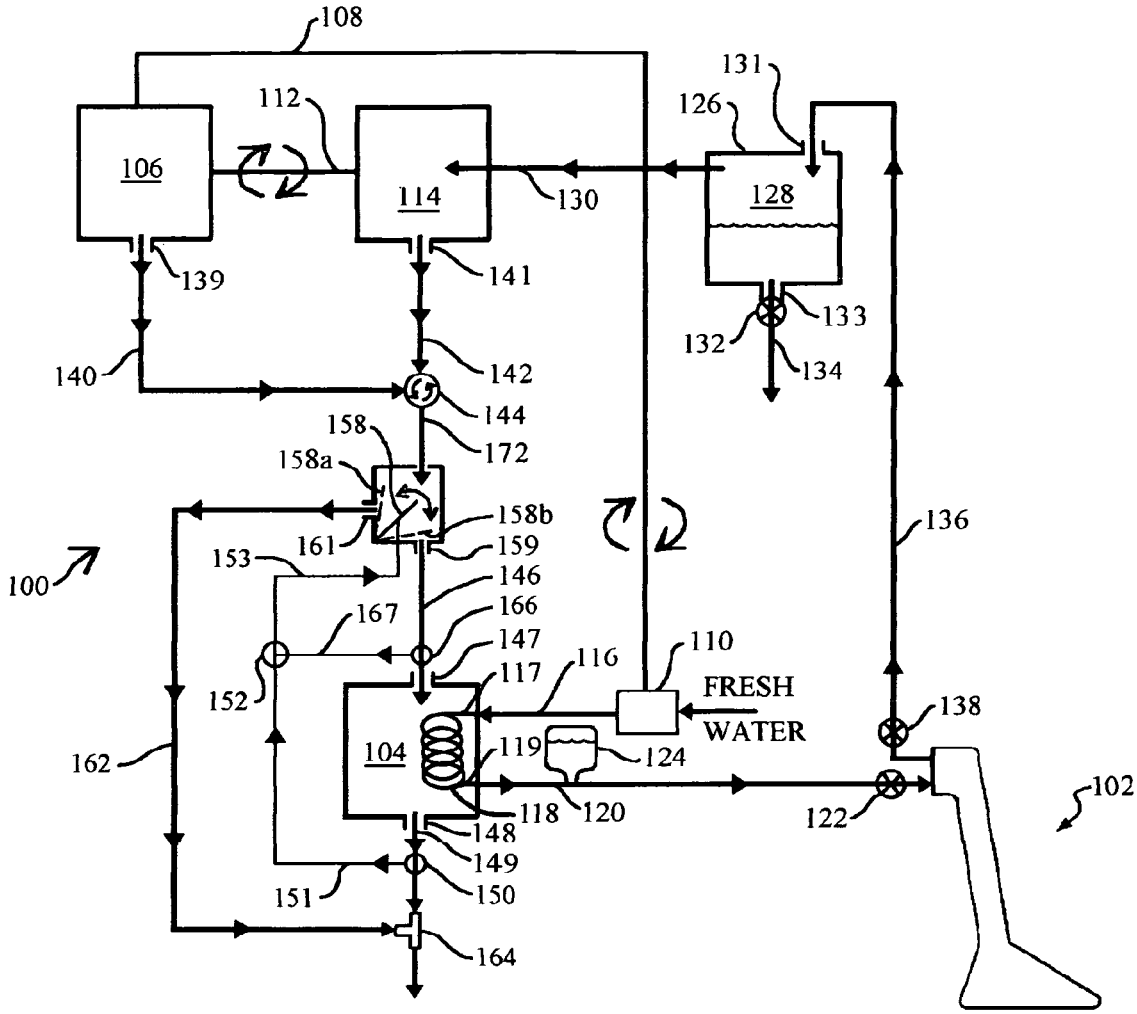
FIG. 5 illustrates yet another alternative embodiment of the carpet cleaning apparatus of the present invention structured for directing hot gasses from the internal combustion engine and vacuum pump to a mixing chamber before delivery to the diverter for subsequent delivery to the heat exchanger.

FIG. 5 illustrates another alternative embodiment of the carpet cleaning apparatus 100 of the present invention having the novel heat exchanger 104 of the invention, wherein the diverter 156 is positioned between the mixer 144 and the heat exchanger 104. Accordingly, the hot engine exhaust gases and hot gases expelled by the vacuum pump 114 are output to the mixer 144 through the respective exhaust pipes 140, 142 where they are mixed. The mixer 144 outputs the mixture of hot gases via a transfer pipe 172 to the diverter 156 which is coupled via the transfer pipe 146 to the inlet duct 147 of the heat exchanger 104.

As discussed above, the valve 158 of the diverter 156 is operable between HEAT MODE and DIVERT MODE as a function of the control signal 153 output by the control circuit 152 which is responsive to the output signal 151 of the first exhaust gas temperature sensor 150, and the output signal 167 of the second exhaust gas temperature sensor 166 if present. In the HEAT MODE, the diverter valve 158 is operated to open the first path through its first transfer outlet 159 that is coupled to the inlet duct 147 of the heat exchanger 104 through the transfer pipe 146. Accordingly, in the HEAT MODE the operation of the diverter valve 158 causes the mixed hot gases from the engine 106 and vacuum pump 114 to be delivered to the heat exchanger 104 via the transfer pipe 146. As discussed above, in the HEAT MODE, operation of the valve 158 of the diverter 156 closes the exhaust path through the second exhaust outlet 161 and the diverter exhaust pipe 162 leading away from the gas mixer 144. Accordingly, in HEAT MODE the operation of the diverter valve 158 inhibits the mixture of hot exhaust gases from the mixer 144 from being diverted away from the heat exchanger 104 through the diverter exhaust pipe 162.

In DIVERT MODE, the diverter valve 158 is operated to close the first transfer outlet 159 leading to the heat exchanger 104, and to simultaneously open the second exhaust outlet 161 which opens the second path through the diverter exhaust pipe 162 leading away from the heat exchanger 104 for being exhausted into the surrounding environment instead. Accordingly, in DIVERT MODE the operation of the valve 158 of the diverter 156 inhibits the mixture of hot exhaust gases from communicating with the heat exchanger 104, and instead diverts the hot exhaust gases away from the heat exchanger 104 and into the diverter exhaust pipe 162.

As discussed above, the diverter 156 is either a continuous or graduated device, or alternatively an "on-off" device wherein the valve 158 of the diverter 156 operates at extremes between the first HEAT MODE position 158*a* that completely opens the input path through the transfer pipe 160 into the mixer 144, and simultaneously substantially closes off the exhaust path through the diverter exhaust pipe 170 to the atmosphere; and the second DIVERT MODE position 158*b* that substantially closes off the input path through the transfer pipe 160 into the mixer 144, and simultaneously completely opens the exhaust path through the diverter exhaust pipe 170 to the atmosphere.

While the preferred embodiment of the invention has been illustrated and described, it will be appreciated that various changes can be made therein without departing from the spirit and scope of the invention. For example, materials may be substituted for the different components of the heat exchanger apparatus of the invention without departing from the spirit and scope of the invention. Therefore, the inventor makes the following claims.

What is claimed is:

1. A liquid heating system, comprising:

a first pipe structured to convey hot gases from a first independent source of relatively higher temperature gases;

a second pipe structured to convey hot gases from a second independent source of relatively lower temperature gases;

a heat exchange chamber that is coupled for receiving a mixture of hot gases from the first and second pipes thereinto and having a heat exchange mechanism that is structured for passing pressurized liquid therethrough, the heat exchange chamber being further structured for exhausting the mixture of hot gases;

a temperature sensor positioned within the heat exchange chamber; and a diverter coupled between the first pipe and the heat exchange chamber, the diverter being structured for diverting the hot gases from the first independent source of relatively higher temperature gases away from the heat exchange chamber as a function of a temperature of the heat exchange chamber, as measured by the temperature sensor, while the heat exchange chamber continues to receive the hot gases from the second independent source of relatively lower temperature gases;

wherein the temperature sensor is structured to detect a maximum chamber temperature and a minimum chamber temperature, and wherein the temperature sensor and diverter are operable to prevent the heat exchange chamber from falling below the minimum chamber temperature and from rising above the maximum chamber temperature.

2. The system of claim 1 wherein the diverter is further responsive to a control signal generated as a function of the heat exchange chamber.

3. The system of claim 2, further comprising a control circuit that is structured to generate the control signal.

4. The system of claim 3, further comprising:

a power plant having an exhaust outlet coupled to the first pipe;

a vacuum generator having an exhaust outlet coupled to the second pipe; and a liquid pressurizing device coupled to an inlet of the heat exchange mechanism.

5. The system of claim 1, further comprising a gas mixing chamber coupled for receiving the hot gases from the first and second pipes thereinto and outputting the mixture of hot gases to the heat exchange chamber.

6. The system of claim 5 wherein the gas mixing chamber is further coupled between the diverter and the heat exchange chamber.

7. The system of claim 6, further comprising a plurality of diverters, one of the diverters coupled between each of the first and second pipes and the gas mixing chamber.

8. A liquid heating system, comprising:

a first exhaust pipe structured to convey heated gases from a power plant;

a second exhaust pipe structured to convey heated gases from a vacuum pump;

a gas mixing chamber communicating with both the first and second exhaust pipes and being structured for mixing hot exhaust gases received therein;

a heat exchange chamber coupled to the gas mixing chamber for receiving mixed hot exhaust gases thereinto in thermal transfer communication with a heat exchange mechanism structured for passing pressurized liquid therethrough; and a temperature sensor positioned within the heat exchange chamber for measuring a temperature of the heat exchange chamber and outputting a first temperature signal representative of the measured temperature; and a diverter between the first exhaust pipe and the gas mixing chamber, the diverter being structured for diverting the heated gases from the power plant away from the heat exchanger as a function of the first temperature signal while the heat exchanger continues to receive the heated gases from the vacuum pump;

wherein the temperature sensor is structured to detect a maximum chamber temperature and a minimum chamber temperature, and wherein the temperature sensor and diverter are operable to prevent the heat exchange chamber from falling below the minimum chamber temperature and from rising above the maximum chamber temperature.

9. The system of claim 8 wherein the diverter further comprises a diverter valve operable between a first outlet communicating with the gas mixing chamber and a second outlet inhibited from communicating with the gas mixing chamber.

10. The system of claim 9, further comprising a control circuit coupled to the temperature sensor for receiving the first temperature signal, and structured for outputting a control signal as a function of the first temperature signal; and wherein the diverter valve is further responsive to the control signal for operating between the first and second outlets of the diverter.

11. The system of claim 10 wherein the diverter valve is further operable in a HEAT MODE for substantially fully opening the first outlet of the diverter and substantially fully closing the second outlet, and is further operable in a DIVERT MODE for substantially fully closing the first outlet of the diverter and substantially fully opening the second outlet.

12. The system of claim 10, further comprising a second diverter between the second exhaust pipe and the gas mixing chamber, the second diverter being structured for diverting the heated gases from the vacuum pump away from the heat exchanger as a function of the control signal.

13. The system of claim 10, further comprising:

a power plant coupled to the first pipe via an exhaust outlet thereof;

a vacuum pump coupled to the second pipe via an exhaust outlet thereof; and a liquid pressurizing pump coupled to an inlet of the heat exchange mechanism.

14. The system of claim 13, further comprising:

a recovery vessel having a fluid inlet;

a fluid dispersal and retrieval device coupled via a high-pressure hose to an outlet of the heat exchange mechanism and coupled via a vacuum hose to the fluid inlet of the recovery vessel; and wherein the vacuum pump is further coupled to draw a vacuum in the recovery vessel.

15. A liquid heating system, comprising:

a first exhaust pipe structured to convey heated gases from a power plant;

a second exhaust pipe structured to convey heated gases from a vacuum pump;

a gas mixing chamber communicating with both the first and second exhaust pipes and being structured for mixing hot exhaust gases received therein;

a heat exchange chamber communicating with the gas mixing chamber for receiving mixed hot exhaust gases thereinto in thermal transfer communication with a heat exchange mechanism structured for passing pressurized liquid therethrough;

a temperature sensor positioned within the heat exchange chamber for measuring a temperature of the heat exchange chamber and outputting a first temperature signal representative of the measured temperature; and a diverter between the gas mixing chamber and the heat exchange chamber, the diverter being structured for diverting the mixed hot exhaust gases away from the heat exchange chamber as a function of the first temperature signal, wherein the diverter is operable in an incremental manner to divert a first portion of the mixed hot exhaust gases away from the heat exchange chamber while supplying a second portion of the mixed hot exhaust gases to the heat exchange chamber;

wherein the temperature sensor is structured to detect a maximum chamber temperature and a minimum chamber temperature, and wherein the temperature sensor and diverter are operable to prevent the heat exchange chamber from falling below the minimum chamber temperature and from rising above the maximum chamber temperature.

16. The system of claim 15, further comprising a control circuit coupled to the temperature sensor for receiving the first temperature signal, and structured for outputting a control signal as a function of the first temperature signal; and wherein the diverter is further responsive to the control signal for operating between a first outlet thereof communicating with the heat exchange chamber, and a second outlet thereof that is inhibited from communicating with the heat exchange chamber.

17. The system of claim 15, further comprising:

a power plant coupled to the first pipe via an exhaust outlet thereof;

a vacuum pump coupled to the second pipe via an exhaust outlet thereof; and a liquid pressurizing pump coupled to an inlet of the heat exchange mechanism.

18. The system of claim 17, further comprising:

a recovery vessel having a fluid inlet;

a fluid dispersal and retrieval device coupled via a high-pressure hose to an outlet of the heat exchange mechanism and coupled via a vacuum hose to the fluid inlet of the recovery vessel; and wherein the vacuum pump is further coupled to draw a vacuum in the recovery vessel.

19. A method for heating a liquid, the method comprising:

conveying liquid to be heated to a heat exchange mechanism positioned within a heat exchange chamber;

conveying hot gases from a first independent source of relatively higher temperature gases to a gas mixing chamber;

conveying hot gases from a second independent source of relatively lower temperature gases to the gas mixing chamber;

conveying mixed hot gases from the gas mixing chamber into the heat exchange chamber and into thermal transfer communication with the heat exchange mechanism for transferring heat from the gases to the liquid to be heated;

measuring a temperature of the gases with a temperature sensor positioned within the heat exchange chamber; and diverting at least a portion of the gases from the first independent source of relatively higher temperature gases away from the gas mixing chamber as a function of the temperature of the gases within the heat exchange chamber while continuing to supply hot gases from the second independent source of relatively lower temperature gases to the gas mixing chamber;

wherein the temperature sensor is structured to detect a maximum chamber temperature and a minimum chamber temperature, and wherein the temperature sensor and diverter are operable to prevent the heat exchange chamber from falling below the minimum chamber temperature and from rising above the maximum chamber temperature.

20. The method of claim 19, further comprising controlling the alternately diverting and directing of at least a portion of the relatively higher temperature hot gases away from or into the gas mixing chamber with a control circuit.

21. The method of claim 19 wherein the alternately diverting and directing of at least a portion of the relatively higher temperature hot gases away from or into the gas mixing chamber further comprises alternately diverting and directing substantially all of the relatively higher temperature hot gases away from or into the gas mixing chamber.

22. The method of claim 19, further comprising intermittently receiving the liquid from the heat exchange mechanism into a fluid dispersal and retrieval device via a high-pressure hose.

23. The method of claim 22, further comprising retrieving spent liquid via a vacuum hose coupled between the fluid dispersal and retrieval device and a vacuum pump.

24. A liquid heating system, comprising:

a first pipe structured to convey hot gases from a power plant;

a second pipe structured to convey hot gases from a vacuum pump;

a heat exchange chamber that is coupled for receiving hot gases from the first and second pipes thereinto and having a heat exchange mechanism that is structured for passing pressurized liquid therethrough, the heat exchange chamber being further structured for exhausting the hot gases;

a temperature sensor positioned within the heat exchange chamber; and a diverter coupled between one of the first and second pipes and the heat exchange chamber, the diverter being structured for diverting the hot gases away from the heat exchange chamber as a function of a temperature of the heat exchange chamber, as measured by the temperature sensor, while the heat exchange chamber continues to receive the hot gases from the other one of the first and second pipes;

wherein the temperature sensor is structured to detect a maximum chamber temperature and a minimum chamber temperature, and wherein the temperature sensor and diverter are operable to prevent the heat exchange chamber from falling below the minimum chamber temperature and from rising above the maximum chamber temperature.

* * * * *